United States Patent [19]

Ito et al.

[11] Patent Number: 4,598,676

[45] Date of Patent: Jul. 8, 1986

[54] GLOW PLUG FOR AN INTERNAL COMBUSTION ENGINE

[75] Inventors: Novuei Ito, Nukata; Kinya Atsumi, Toyohashi; Naohito Mizuno, Okazaki; Tetsuro Kikuchi, Nishio, all of Japan

[73] Assignee: Nippon Soken, Inc., Nishio, Japan

[21] Appl. No.: 580,182

[22] Filed: Feb. 15, 1984

[30] Foreign Application Priority Data

Feb. 18, 1983 [JP] Japan ..... 58-26754

[51] Int. Cl.[4] ..... F02N 17/00

[52] U.S. Cl. ..... 123/145 A; 219/270; 219/553

[58] Field of Search ..... 123/145 R, 145 A; 219/267, 270, 351, 352, 353, 541, 542, 544, 552, 553; 361/264, 265, 266

[56] References Cited

U.S. PATENT DOCUMENTS

| | | | |
|---|---|---|---|
| 3,449,638 | 6/1969 | Beesch | 123/145 R |
| 4,351,291 | 9/1982 | Mahaney | 123/145 A |
| 4,357,526 | 11/1982 | Yamamoto | 123/145 A X |
| 4,401,065 | 8/1983 | Minegishi et al. | 123/145 A |
| 4,437,440 | 3/1984 | Suzuki et al. | 123/145 A |
| 4,486,651 | 12/1984 | Atsumi et al. | 123/145 A X |

FOREIGN PATENT DOCUMENTS

| | | | |
|---|---|---|---|
| 2092670 | 8/1982 | United Kingdom | 219/270 |

*Primary Examiner*—W. R. Wolfe

*Attorney, Agent, or Firm*—Cushman, Darby & Cushman

[57] ABSTRACT

A glow plug for an internal combustion engine is disclosed. The glow plug of the present invention comprises a heater support member projecting into a combustion chamber of an internal combustion engine, the heater support member being formed of an electric insulating material; a heater member affixed to the outer surface of the heater support member, the heater member being formed of an electrically conductive, heat- and oxidation-resistant ceramic material; at least three lead wires for power supply embedded in the heater support member, one end of the lead wires being connected each independently to the heater member; and a power switching means interposed between the other ends of those lead wires and a power source for connecting the power source selectively between the lead wires. By the selective connection between the lead wires performed by the power switching means, a plurality of heater elements having different resistance values are formed within the heater member.

8 Claims, 6 Drawing Figures

GLOW PLUG FOR AN INTERNAL COMBUSTION ENGINE

BACKGROUND OF THE INVENTION

The present invention relates to a glow plug for an internal combustion engine and more particularly to a glow plug suitable for a diesel engine.

In diesel engines, a glow plug is now used as a part for starting at low temperatures, and in order to improve the starting characteristic of diesel engines, a small-sized, fast-heating glow plug is now desired.

Most conventional glow plugs are sheathed type glow plugs, in which a heating wire made of Ni-Cr alloy or like material is wound in the form of a coil and placed in a sheath which is formed of a heat- and corrosion-resistant alloy such as stainless steel or inconel and whose one end is closed, and the interior portion of the sheath around the heating wire is filled with an insulating material such as magnesium oxide. In glow plugs of this type, therefore, since the heat conduction between the heating wire and the sheath is effected through the insulating material, it takes time for the surface of the sheath to be heated to redness for igniting a fuel-air mixture, that is, the preheating time is prolonged.

In an effort to solve such problems, that is for attaining rapid heating in sheathed type glow plugs, there is adopted a method in which the rated voltage is set at a low level, and during preheating, a battery voltage higher than the rated voltage is temporarily applied directly for rapid glowing, while during after-glow after start-up of the engine, the battery voltage is dropped by means of a resistor and the rated voltage is applied. In such method, however, it is necessary that a resistor having a fairly large capacity and hence involving generation of heat should be provided separately or as a built-in component, thus causing problems such as an increase in installation space required and a more complicated structure of glow plug, as well as wasteful power consumption in the resistor.

SUMMARY OF THE INVENTION

It is an object of the present invention to provide a glow plug for an engine superior in the rapid heating characteristic.

It is another object of the present invention to provide a glow plug for an engine free from wasteful power consumption.

It is a further object of the present invention to provide a glow plug for an engine capable of appropriately controlling the quantity of generated heat according to the state of preheating and that of after-glow.

In the glow plug of the present invention, a heater member formed of an electrically conductive ceramic material superior in heat- and oxidation-resistance is affixed to the surface of an electrically insulative heater support member projecting into a combustion chamber of an engine. In the heater support member are embedded at least three lead wires for power supply, one ends of which are each independently connected to the heater member and the other ends of which are connected to a power source through a power switching means. The power switching means has a contact for connecting the power source selectively between the lead wires according to the state of preheating in an engine combustion chamber. Through this switching operation of the power switching means there are formed plural heater elements having different resistance values in the heater member.

BRIEF DESCRIPTION OF THE DRAWINGS

FIGS. 1 through 4 illustrate a first embodiment of the present invention;

FIG. 1 is a longitudinal sectional view of a projecting end portion of a glow plug projecting into a combustion chamber of an internal combustion engine;

FIG. 2 is a perspective view showing a lamination structure of ceramic green sheets which are integrally laminated and sintered into a heater support member and a heater member;

FIG. 3 is a circuit diagram of a power switching circuit;

FIG. 4 is a view showing changes with time of the temperature of the glow plug.

FIG. 5 is a sectional view showing a structure and an electrical connection of a heater support member and a heater member; and FIG. 6 is an electric equivalent circuit showing states of power supply to the heater member.

DESCRIPTION OF THE PREFERRED EMBODIMENTS

The present invention will be described hereinunder on the basis of its illustrated embodiments.

Figure 1:
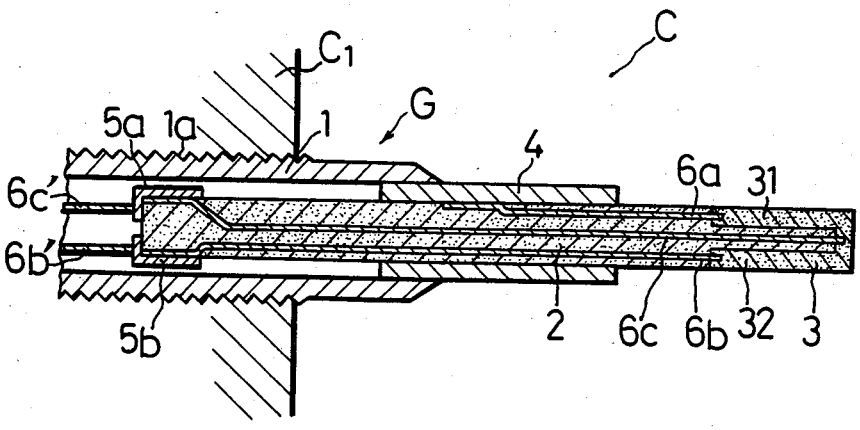

Referring first to FIG. 1, there is shown a tip end portion of a glow plug G projecting into a combustion chamber C through a combustion chamber wall C1 of an internal combustion engine. In a tip-end opening of a cylindrical metallic case 1 of the glow plug G is disposed a rod-like heater support member 2 formed of an insulating ceramic material, the heater support member 2 projecting from the tip-end opening of the case 1. To the surface of the tip end portion of the heater support member 2 if affixed a heater member 3 formed of an electrically conductive ceramic material. The heater member covers in U-shaped form the tip end face of the heater support member as well as the upper and lower faces of the heater support member contiguous to the end face. Fitted over the outer periphery of the support member 2 is a metallic sleeve 4, which is fixed to the opening portion of the case 1 by soldering. Metallic caps 5*a* and 5*b* are attached to the base end of the support member 2. Within the support member 2 are embedded first to third lead wires 6*a*, 6*b* and 6*c* for the supply of electricity. The first lead wire 6*a* is connected at one end thereof to the heater member 3 and at the other end thereof to the sleeve 4. The second and third lead wires 6*b* and 6*c* are connected at one end to the heater member 3 and at the other ends thereof to the caps 5*b* and 5*a*, respectively. One end of the third lead wire 6*c* is connected to the heater member substantially intermediately between the connection points of the other lead wires 6*a* and 6*b*. Therefore, the resistance value of a heater element 31 formed between the first and third lead wires 6*a* and 6*c* and that of a heater element 32 formed between the second and third lead wires 6*b* and 6*c* are almost equal.

To the caps 5*a* and 5*b* are connected one end of lead wires 6*c*′ and 6*b*′, respectively, the other ends of the lead wires 6*c*′ and 6*b*′ extending up to outlet terminals (not shown) of the glow plug G. On the outer periphery of the case 1 is formed a screw portion 1*a*, whereby the body of the glow plug G is fixed to the combustion chamber wall C1.

As the insulating ceramic material which forms the support member 2, there is used a sintered product of a mixture of alumina ($Al_2O_3$) and silicon nitride ($Si_3N_4$), and as the electrically conductive ceramic material which forms the heater member 3, there is used a sintered product of a mixture of molybdenum disilicate ($MoSi_2$) and $Si_3N_4$. $MoSi_2$ is extremely superior in the resistance to oxidation and to heat, and $Si_3N_4$ is used for imparting resistance to thermal shock and also for adjusting the resistance value. As the first to third lead wires 6*a*–6*c*, nickell wires are used.

Figure 2:
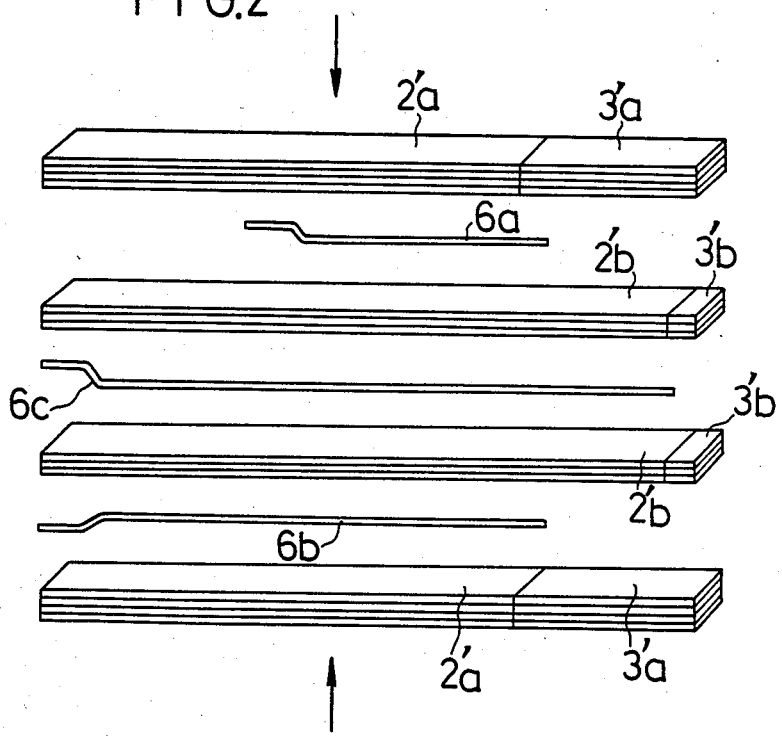

An example of a procedure for forming an integral structure of the support member 2 and the heater member 3 will now be described with reference to FIG. 2. Predetermined amounts of $Al_2O_3$ powder and $Si_3N_4$ powder are mixed, to which is added a suitable organic binder, and the mixture is formed into ceramic green sheets according to the doctor blade method. The ceramic green sheets thus obtained are laminated into two sets of ceramic sheets 2'*a* and another two sets of ceramic sheets 2'*b*, each set comprising several ceramic green sheets. Next, predetermined amounts of $MoSi_2$ powder and $Si_3N_4$ powder are mixed, and then in the same way as above there are obtained two sets of ceramic sheets 3'*a* and another two sets of ceramic sheets 3'*b*. Then, the ceramic sheets 2'*a* and 3'*a* are affixed together, and the ceramic sheets 2'*b* and 3'*b* also joined. The ceramic sheets thus combined are then laminated so that the lead wires 6*a*, 6*b* and 6*c* are disposed in a sandwiched manner. This laminating operation is performed while applying pressure in the arrowed directions in FIG. 2. The laminate thus obtained is then hot-pressed and sintered at a temperature of about 1,600° C. in an inert atmosphere to obtain an integral ceramic body having the support member 2 and the heater member 3. The surface of the ceramic body is then polished and metallized, and thereafter the sleeve 4 and the caps 5*a* and 5*b* are attached thereto.

In FIG. 3, there is shown a circuit for a power supply to the glow plug, in which the numeral 7 denotes a battery, numeral 8 denotes a resistor of a small resistance value (about 10 mΩ) and numeral 9 denotes a power switching circuit.

A timer circuit 91 which is a constituent of the power switching circuit 9 is connected to a starter switch 10. Its output continues to be "1" state for 10 minutes after operation of the starter switch 10.

A vehicle speed detecting circuit 92, which is connected to a vehicle speed sensor 11, produces a "1" state output at a vehicle speed not higher than 20 km/hr.

An engine rotation detecting circuit 93, which is connected to a neutral point of a stator coil (not shown) incorporated in an alternator 12, produces a "1" state output during rotation of the engine.

A water temperature detecting circut 94, which is connected to a water temperature sensor 13, produces a "1" state output at a water temperature not higher than 60° C.

A glow temperature detecting circuit 95 is supplied with the voltage across the resistor 8 which is disposed between the battery 7 and the glow plug G. As the resistance value of the heater elements 31 and 32 of the glow plug G varies with increase in temperature, the said input voltage to the glow temperature detecting circuit 95 also varies, and the circuit 95 detects this change in voltage and produces an output having such a hysteresis as exhibits a "1" state at a glow plug G temperature not lower than 1,000° C. and a "1" level at not higher than 750° C.

The power supplying lead wire 6*b* of the glow plug G is connected to the resistor 8 through a contact 97*a* of an output relay 97 of the power switching circuit 9, and the power supplying lead wire 6*c* is connected to the resistor 8 through a normally open contact 96*a* of an output relay 96. The power supplying lead wire 6*a* is grounded through the case 1 (see FIG. 1) of the glow plug G. The contact 97*a* conducts between C1 and C3 when the relay 97 is energized.

The power switching circuit 9 having the above-described configuration operates in the following manner.

When the power source is turned on to start preheating, the output of the engine rotation detecting circuit 93 and that of the glow temperature detecting circuit 95 are both at "0" state, so that the output of a NOR gate 98 becomes "1" state and the relay 96 is energized to close its contact 96*a*. At this time, the relay 97 is in a non-energized state, with its contact 97*a* conducting between C1 and C2, and the second lead wire 6*b* of the glow plug G is grounded. Consequently, the battery 7 is connected between the third lead wire 6*c* and the other two lead wires 6*a*, 6*b*, that is, the heater elements 31 and 32 are connected in parallel with the battery 7. In this state, if the resistance of each of the heater elements 31 and 32 is R and the voltage of the battery 7 is E, the electric power applied to the heater elements 31 and 32 is approximately $2E^2/R$, so that the temperature of the glow plug G rises rapidly from point S to point T in the graph of FIG. 4.

When the temperature of the glow plug G reaches 1,000° C. (point T in FIG. 4), the temperature detecting circuit 95 produces "1" state output signal, then AND gate 99*a* and NOR gate 98 produce "1" state output signals, whereby the relay 97 is energized through OR gate 100 in place of the relay 96 and its contact 97*a* conducts between C1 and C3, while the contact 96*a* opens. In this state, the battery 7 is connected to the lead wires 6*a* and 6*b*, that is, the heater elements 31 and 32 are connected in series with the battery 7. Consequently, the electric power applied to the heater elements 31 and 32 is reduced to $E^2/2R$ which corresponds to one fourth of the electric power applied in the foregoing parallel connection, so that the temperature of the glow plug G drops rapidly (from point T to point U in FIG. 4).

When the temperature reaches 750° C. (point U in the figure), the output of the temperature detecting circuit 95 again becomes "0" state and the relays 97 and 96 assume non-energized and energized states, respectively, whereby the heater elements 31 and 32 of the glow plug G are again connected in parallel with the battery 7 and the temperature of the glow plug G begins to rise. In this way, the temperature of the glow plug G is held at a level between 750° C. and 1,000° C. during preheating.

When the starter switch 10 is turned on and the engine starts rotating, the timer circuit 91 and the engine rotation detecting circuit 93 produce "1" state output signals, whereupon the output of the NOR gate 98 and that of the AND gate 99*b* become "0" and "1" states, respectively, so that the relays 96 and 97 assume non-energized and energized states, respectively, and during the subsequent after-glow, the heater elements 31 and 32 of the glow plug G are connected in series with the battery 7 regardless of the temperature of the glow plug G. As a result, the temperature of the glow plug G begins to drop (point W in FIG. 4) and becomes an after-glow level (about 650° C. in the illustrated embodiment) which is lower than the foregoing preheating temperature.

Figure 4:
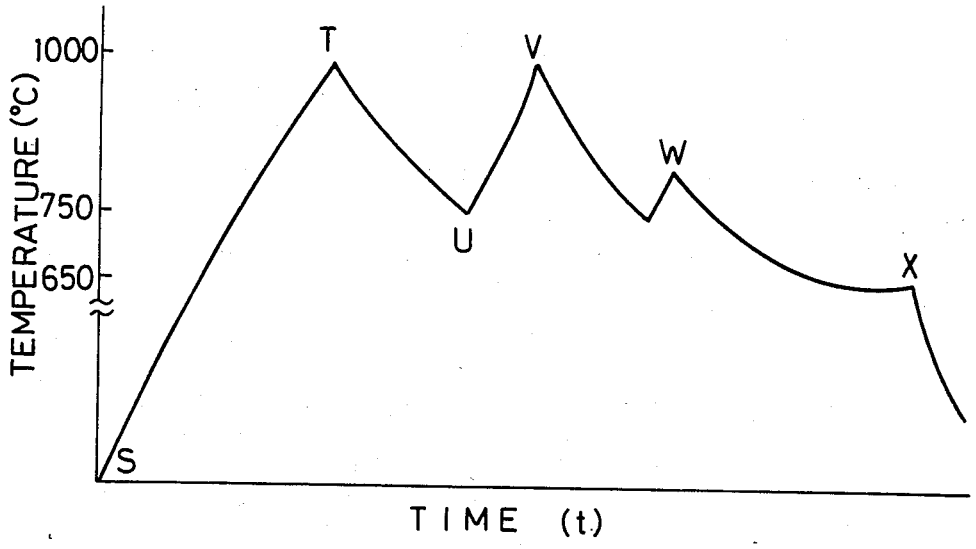

Then, in 10 minutes after operation of the starter switch 10, or when the vehicle begins to run, or when the cooling water temperature rises above 60° C., the relay 97 becomes non-energized since the OR gate 100 inputs are "0" states, so that the power supply to the glow plug G is stopped (point X in FIG. 4).

Thus, in the glow plug of the present invention, during preheating, the heater elements formed between lead wires are connected in parallel with the power source to lower the resistance value of the entire heater member to thereby increase its quantity of generated heat for effecting a rapid heating, while during after-glow, those heater elements are connected in series with the power source to increase the resistance value of the entire heater member to thereby decrease its quantity of generated heat for maintaining the temperature at a lower level than that during preheating. Therefore, unlike conventional glow plugs, it is not necessary to provide a resistor of large capacity between the power source and the glow plug during after-glow, and hence there is no wasteful power consumption due to such a resistor.

Moreover, since the heater member is formed on the surface of the heater support member, an extremely rapid heating characteristic is attained. Further, since the heater member is formed of a ceramic material superior in oxidation- and heat-resistance, a prolonged service life is assured.

Figure 5:
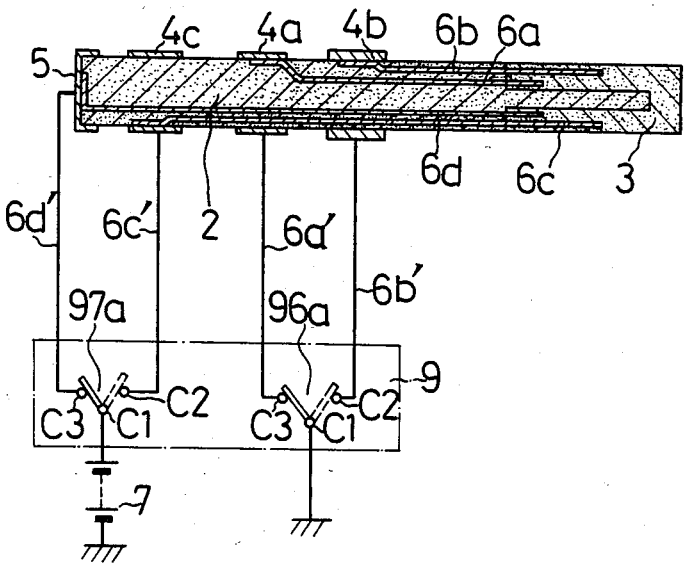
FIGS. 5 and 6 illustrate a second embodiment of the present invention.

Referring now to FIG. 5, there is illustrated a second embodiment of the present invention, in which four, first to fourth, lead wires 6*a*, 6*b*, 6*c* and 6*d* for power supply are embedded within a support member 2, one end of the lead wires 6*a*–6*d* being connected to a heater member 3 and the other ends thereof connected to sleeves 4*a*, 4*b*, 4*c* and cap 5, respectively. A switching relay contact 96*a* has one end connected to ground and two other ends, to which are connected the sleeves 4*a* and 4*b* respectively through lead wires 6*a*′ and 6*b*′, while a switching relay contact 97*a* has one end connected to a battery 7 and two other ends, to which are connected the sleeve 4*c* and the cap 5 respectively through lead wires 6*c*′ and 6*b*′. The relay contacts 96*a* and 97*a* conduct between C1 and C2 or between C1 and C3 according to whether they are energized or non-energized. One end of the first lead wire 6*a* and second lead wire 6*b* are connected embeddedly to one end portion of the U-shaped heater member 3. One end of the third lead wire 6*c* and fourth lead wire 6*d* are connected embeddedly to the other end portion of the heater member 3. The second lead wire 6*b* is embedded more deeply than the first lead wire 6*a*, and the third lead wire 6*c* is embedded more deeply than the fourth lead wire 6*d*.

Figure 6:
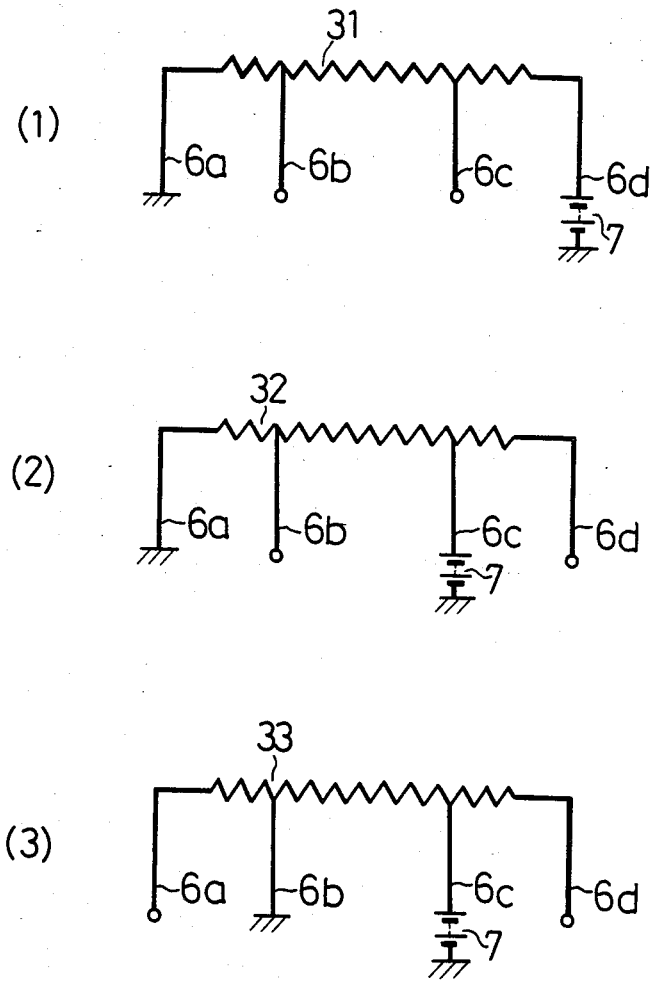

By operating the relay contacts 96*a* and 97*a* in an appropriate manner, the connection between the power supplying lead wires 6*a*–6*d* and the battery 7 can be changed as shown in FIGS. 6(1), (2) and (3); that is, by the relay contacts 96*a* and 97*a* the battery 7 is selectively connected between the first lead wire 6*a* and the fourth lead wire 6*d* (FIG. 6(1)), between the first lead wire 6*a* and the third lead wire 6*c* (FIG. 6(2)), and between the second lead wire 6*b* and the third lead wire 6*c* (FIG. 6(3)). The resistance values of heater elements 31, 32 and 33 formed between the lead wires 6*a*–6*d* are set at 3R, 2R and R respectively in the order of (1), (2) and (3) in FIG. 6, whereby successively larger electric powers like $$\frac{E^2}{3R}, \frac{E^2}{2R} \text{ and } \frac{E^2}{R}$$

are generated in the heater elements 31–33. In this embodiment, even if the battery 7 is connected between the second lead wire 6*b* and the fourth lead wire 6*d*, the same resistance value as that of the heater element 32 is obtained. Since the quantity of generated heat in the heater member 3 can be changed in three stages, not only the same effect as in the first embodiment can be attained, but also the temperature of the combustion chamber can be adjusted more minutely.

In the glow plug of the present invention, as set forth hereinabove, since a heater member formed of an electrically conductive ceramic material is formed on the surface of a support member formed of an insulative ceramic material, the rapid heating characteristic of the glow plug can be remarkably improved. In the glow plug of the present invention, moreover, by supplying electricity to specific lead wires among at least three lead wires for power supply according to the state of preheating and that of after-glow, the resistance value of the heater elements formed therebetween is made variable to control the quantity of generated heat, and therefore it is not necessary to use a resistor of large capacity for lowering the voltage applied to the glow plug during after-glow, that is, wasteful power consumption can be prevented, and the temperature of the engine combustion chamber can be adjusted minutely in stages.

What is claimed is:

1. A glow plug mounted in a combustion chamber of an internal combustion engine, comprising:

(1) a heater support member projecting into the combustion chamber of the internal combustion engine, said heater support member being formed of a mixture containing alumina and silicon nitride;

(2) a heater member affixed to the surface of said heater support member, said heater member being formed of a mixture containing molybdenum disilicate and silicon nitride, said heater support member and said heater member being integrally sintered;

said heater support member being in the form of a rod, and said heater member covering in a U-shaped form the tip end face of said heater support member and the upper and lower face portions of said heater support member contiguous to said end face;

(3) first, second and third lead wires for power supply embedded in said heater support member;

one end of said first lead wire being connected embeddedly to one end portion of said heater member, one end of said second lead wire being connected embeddedly to the other end portion of said heater member and one end of said third lead wire being connected embeddedly to the central portion of said heater member, thereby forming two heater elements having substantially the same resistance value between the lead wires;

(4) a power source; and (5) a power switching means for connecting said power source selectively between said lead wires for power supply according to the state of preheating in said combustion chamber, said power switching means having a switching relay contact for connecting said power source selectively between said third lead wire and the other two lead wires and between said other two lead wires.

2. A glow plug according to claim 1, further comprising a cylindrical metallic case to which the outer peripheral portion of said heater support member is secured through a metallic sleeve.

3. A glow plug mounted in a chamber of an internal combustion engine, comprising:

(1) a heater support member projecting into the combustion chamber of the internal combustion engine, said heater support member being formed of an electric insulating material;

(2) a heater member affixed to the surface of said heater support member, said heater member being formed of an electrically conductive ceramic material superior in resistance to heat and to oxidation, said heater support member being in the form of a rod, and said heater member covering in a U-shaped form the tip and face of said heater support member as well as the upper and lower face portions of said heater support member contiguous to said end face;

(3) first, second, third and fourth lead wires for power supply embedded in said heater support member, one end of the first and second lead wires being, respectively, connected embeddedly to one end portion of said heater member, one end of the third and fourth lead wires being, respectively, connected embeddedly to the other end portion of said heater member, the second lead wire being embedded more deeply than the first lead wire, and the third lead wire being embedded more deeply than the fourth wire, with a plurality of heater elements having different resistant values being formed between the lead wires connected to one end of said heater member and the lead wires connected to the other end of said heater member;

(4) a power source; and (5) a power switching means for connecting said power source selectively between said lead wires for power supply according to the state of preheating in said combustion chamber.

4. A glow plug according to claim 3, wherein said power switching means has a switching relay contact for connecting said power source selectively between said first and fourth lead wires, between said first and third lead wires, between said second and fourth lead wires and between said second and third lead wires.

5. A glow plug according to claim 3, wherein said heater member comprises a sintered product of a mixture of molybdenum disilicate and silicon nitride.

6. A glow plug according to claim 3, wherein said heater support member is formed of an electric insulating ceramic material.

7. A glow plug according to claim 6, wherein said heater support member comprises a sintered product of a mixture of alumina and silicon nitride.

8. A glow plug according to claim 6, wherein said heater support member and said heater member are integrally sintered.

* * * * *